US007100250B2

(12) United States Patent
Fildan et al.

(10) Patent No.: US 7,100,250 B2
(45) Date of Patent: Sep. 5, 2006

(54) GARMENT CLOSURE AND METHOD OF MAKING SAME

(75) Inventors: Gerhard Fildan, Vienna (AT); Karl Wanzenböck, Leobersdorf (AT)

(73) Assignee: Fildan Accessories Corporation, Humble, TX (US)

( * ) Notice: Subject to any disclaimer, the term of this patent is extended or adjusted under 35 U.S.C. 154(b) by 119 days.

(21) Appl. No.: 10/846,156

(22) Filed: May 13, 2004

(65) Prior Publication Data

US 2005/0251970 A1 Nov. 17, 2005

(51) Int. Cl.
*A44B 17/00* (2006.01)

(52) U.S. Cl. ..... 24/591.1; 24/DIG. 43

(58) Field of Classification Search ..... 24/591–596.1, 24/DIG. 43; 450/79, 26, 28, 82, 86
See application file for complete search history.

(56) References Cited

U.S. PATENT DOCUMENTS

| | | | | | |
|---|---|---|---|---|---|
| 4,296,533 | A * | 10/1981 | Doerter | 24/581.1 |
| 4,636,347 | A * | 1/1987 | Kato | 264/251 |
| 5,293,668 | A * | 3/1994 | Tibiletti | 24/16 PB |
| 5,459,907 | A * | 10/1995 | Nivet | 24/484 |
| 5,884,368 | A * | 3/1999 | Boe | 24/16 PB |
| 6,199,248 | B1 * | 3/2001 | Akashi et al. | 24/693 |
| 6,557,232 | B1 * | 5/2003 | Fildan et al. | 29/411 |
| 2002/0124299 | A1 * | 9/2002 | Malcolm | 2/439 |
| 2003/0229975 | A1 * | 12/2003 | Jackson et al. | 24/698.1 |

* cited by examiner

*Primary Examiner*—James R. Brittain
(74) *Attorney, Agent, or Firm*—Andrew Wilford

(57) ABSTRACT

Flexible strips of a garment closure are injection molded around skeletons of the more rigid fastener members which are held together by ligatures embedded in the strip material. The closure members are of the snap/hook-type.

13 Claims, 3 Drawing Sheets

GARMENT CLOSURE AND METHOD OF MAKING SAME

FIELD OF THE INVENTION

Our present invention relates to a garment closure and to a method of making same. More particularly, the invention relates to a closure which can be used on the back strap of a brassiere or the like.

BACKGROUND OF THE INVENTION

In the commonly owned U.S. Pat. No. 6,557,232, there is described a new type of closure, utilizing a snap/hook-type engagement of injection molded synthetic resin male and female members. In that system, the male and female members are injection molded onto fabric tapes.

It is highly desirable to have a fastener, especially for the back strip of a brassiere, which has the flexibility of such fabric tapes but yet a certain rigidity at the interfitting members themselves so as to enable them to engage and disengage in a flawless manner.

The female member of that system comprises a ring which is formed with a lateral inlet opening into a central bore or hole with an overhanging part adapted to engage beneath a head of the male member. The male member may be a stud or pin which can be split to enable it to be inserted laterally using a hook-type engagement which has become a standard in brassiere back fasteners, but enabling separation of the two members like a snap fastener.

While the aforedescribed system is satisfactory for many applications, there are occasions when the qualities or a plastic strip are desirable as a support for the rigid members of the closure.

OBJECTS OF THE INVENTION

It is, therefore, an important object of the present invention to provide an improved garment closure having rigid male and female members and wherein the tape is a synthetic resin or plastic material.

It is another object of the invention to provide a garment closure with the advantage of the garment closure of U.S. Pat. No. 6,557,232 but with additional advantages gained from the fact that the strip carrying the rigid male and female members is composed of a flexible plastic.

Another object is to provide an improved method of making the garment closure.

It is also an object of this invention to provide an improved brassiere with a unique closure for a back strap thereof.

SUMMARY OF THE INVENTION

These objects and others which will become apparent hereinafter are attained in a method of making a garment closure which comprises the steps of:

(a) forming a one-piece closure skeleton comprised of a bar adapted to be secured to one part of a garment, at least one ring adapted to form a male or female fastener member and at least one ligature extending transversely to the bar and secured to the ring; and (b) injection molding onto the skeleton a generally rectangular strip of a synthetic resin material of a substantially uniform width and thickness to completely embed the ligature therein while leaving substantial portions of the member exposed on opposite sides of the strip, the strip having generally parallel longitudinal edges extending perpendicular to the bar at opposite ends thereof.

Advantageously, the skeleton is itself injection molded from a harder synthetic resin than that of the strip which can be highly flexible and even flaccid. The strip can also be composed of a plastic having a different color from that of the skeleton and, for example, even of a clear plastic. Best results have been obtained with polyoxymethylene for the skeleton and polyurethane for the strip.

A second ring can be mounted on one of the strips to form an alternative male or female fastener member and in that case the second ring is connected to the first ring of the strip by a second ligature which is wholly embedded in the strip. The second ring allows the fastener to be adjustable as to its effective length upon the garment.

Each of the rings can have a thin flange extending outwardly around its periphery, connected to the ligature and likewise embedded in the strip.

The ability to injection mold both the closure skeleton and the strip and to embed part os the closure skeleton in the strip during the second injection molding, insures a permanent coupling between the strip and the skeleton.

The garment closure thus can comprise:

a first closure unit comprising a first one-piece closure skeleton comprised of a first bar adapted to be secured to one part of a garment, at least one first ring adapted to form a male fastener member and at least one ligature extending transversely to the bar and secured to the ring, and a generally rectangular first strip molded from a synthetic resin material of a substantially uniform width and thickness to completely embed the ligature therein while leaving portions of the member exposed on opposite sides of the strip, the strip having generally parallel longitudinal edges extending perpendicular to the bar at opposite ends thereof; and a second closure unit comprising a second one-piece closure skeleton comprised of a second bar adapted to be secured to another part of a garment, at least one second ring adapted to form a female fastener member capable of mating with the male fastener member and at least one ligature extending transversely to the bar of the second skeleton and secured to the second ring, and a generally rectangular second strip molded from a synthetic resin material of a substantially uniform width and thickness to completely embed the ligature of the second skeleton therein while leaving portions of the female member exposed on opposite sides of the second strip, the second strip having generally parallel longitudinal edges extending perpendicular to the second bar at opposite ends thereof, whereby the members are releasably engageable upon attachment of the units to the respective parts of the garment.

The male and female members can be of the snap/hook-type described in U.S. Pat. No. 6,557,232.

It has been found to be advantageous, moreover, to provide each of the bars with a plurality of pointed pins which can engage into the fabric of the garment in mounting the fastener units thereon. A cover plate on the opposite side of the fabric is welded through the fabric to the pins and the bar.

The garment is preferably a brassiere and the parts thereof to which the closure units of the fastener are secured are preferably the parts of the back strap of the brassiere.

BRIEF DESCRIPTION OF THE DRAWING

The above and other objects, features, and advantages will become more readily apparent from the following description, reference being made to the accompanying drawing in which.

SPECIFIC DESCRIPTION

Figures 1, 2, 6, 7, 11, 12, 13:
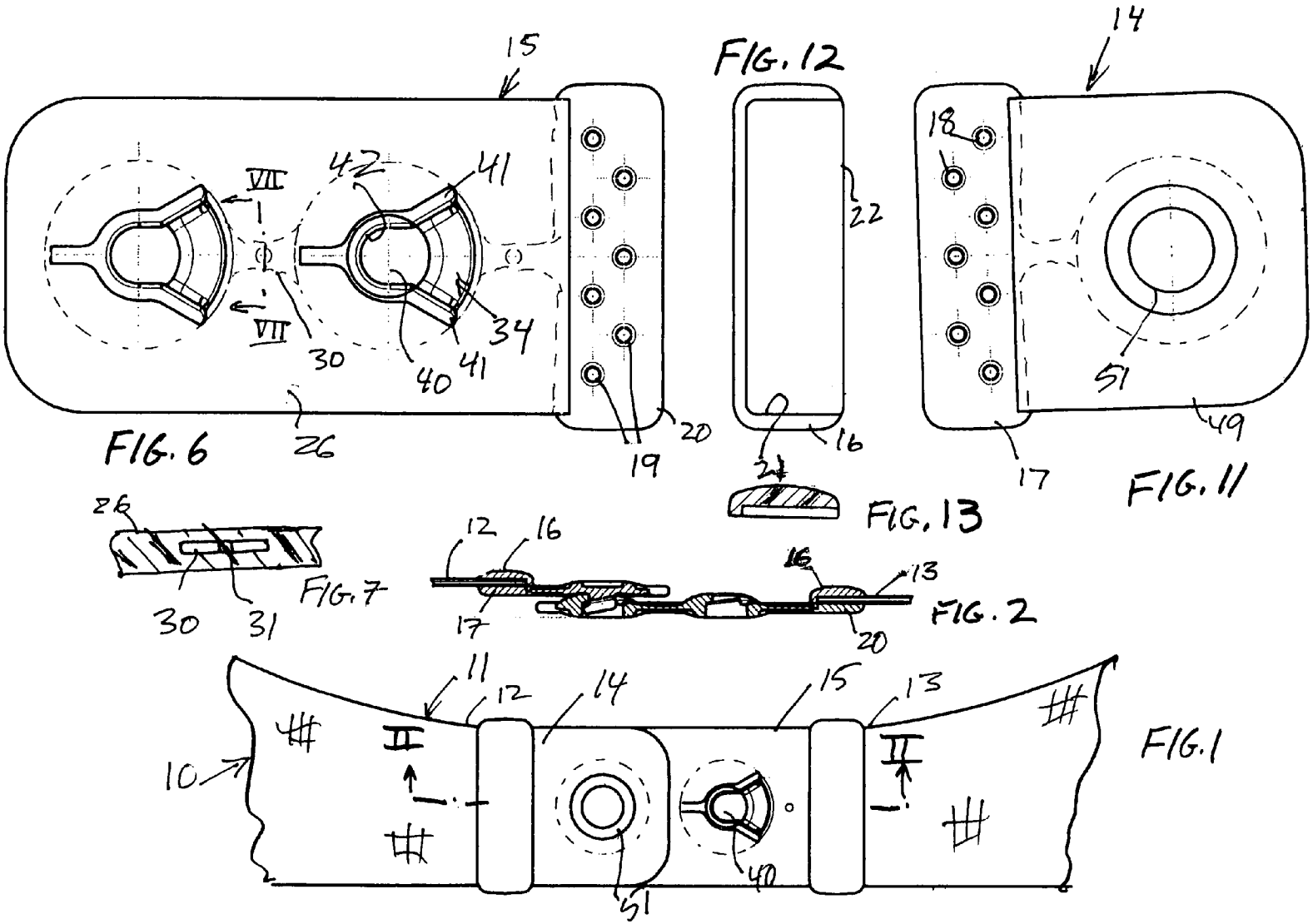
FIG. 1 is an elevational view in diagrammatic form of the back strip of a brassiere provided with a fastener according to the invention.
FIG. 2 is a cross sectional view taken along lines II—II of FIG. 1.
FIG. 6 is an elevational view of the fastener part shown in FIG. 4 from the opposite side.
FIG. 7 is a sectional view taken along the line VII—VII but drawn to a much larger scale.
FIG. 11 is an elevational view showing the unit of FIG. 9 from the opposite side.
FIG. 12 is an elevational view of a cover plate.
FIG. 13 is a cross sectional view through the cover plate.

FIG. 1 shows a brassiere 10 having a back strap 11 formed from two parts 12 and 13. The male garment closure unit 14 is here shown engaged with the distal female fastener member of the female closure unit 15. The unit 14 is attached to the strap part 12 and the unit 15 is attached to the strap part 13.

As can be seen from FIG. 2, the strap part 12 is received between a cover plate 16 and the bar 17 of the male closure unit 14, is pierced by the pins 18 thereof and is held in place by the welding of the cover plate 16 to the bar 17 and the pins 18.

Similarly, a cover plate can be welded to the pins 19 of a bar 20 of the female unit 15. The fabric part 13 is thus clamped between the cover plate 16 and the bar 20 and is pierced by the pins 19 (FIG. 2).

As can be seen from FIGS. 12 and 13, the cover plates 16 are formed on one side with a recess 21 receiving the respective fabric end and open at 22 along a longitudinal edge from which the fabric part 12 or 13 emerges from that recess. The cover plates 16 can be coextensive with the bars 17 and 20.

Figure 3:
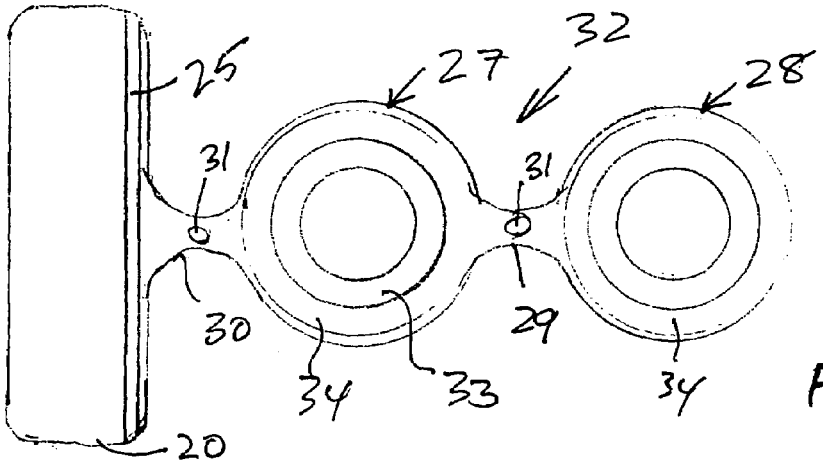
FIG. 3 is an elevational view of the skeleton carrying the female fastener members.
Figure 4:
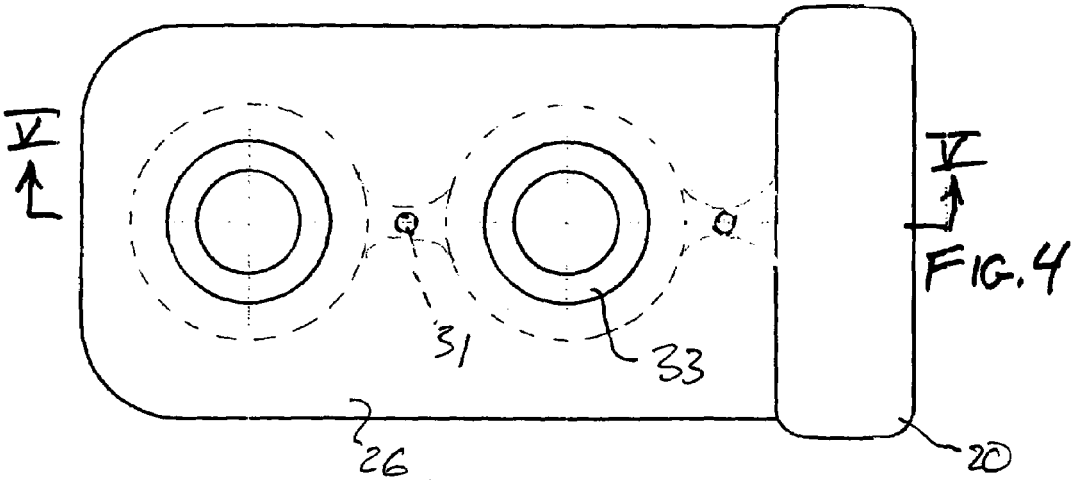
FIG. 4 is an elevational view showing the skeleton embedded in the plastic strip.
Figure 5:
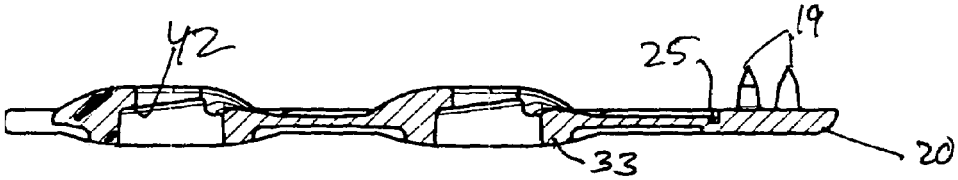
FIG. 5 is a sectional view taken along the line V—V of FIG. 4.
Figure 8:
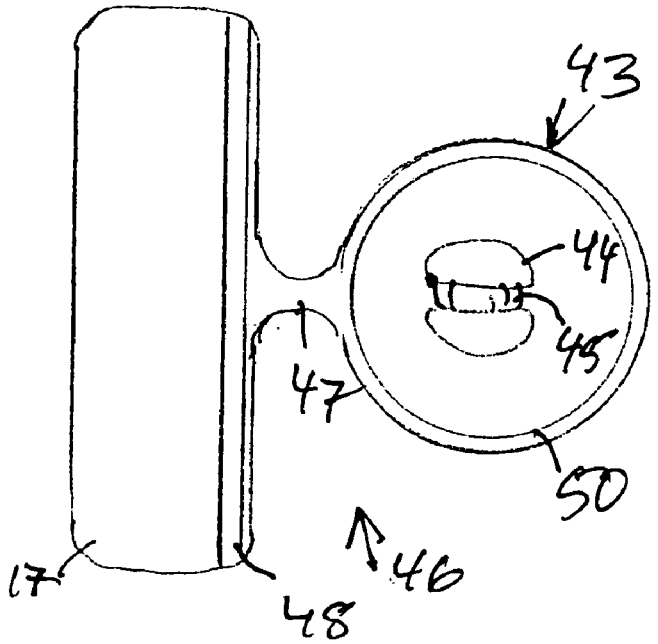
FIG. 8 is a view similar to FIG. 3 of the skeleton for the male fastener member.
Figure 9:
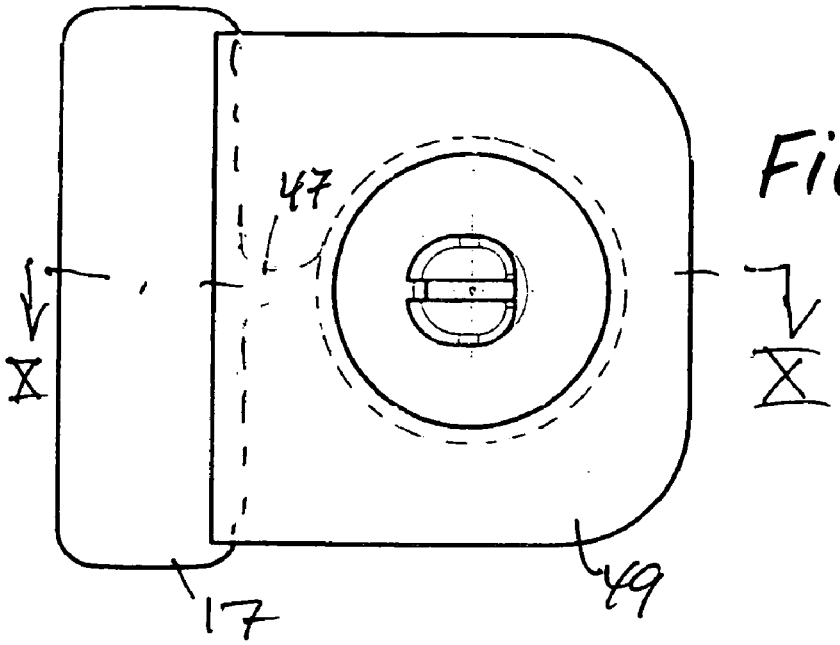
FIG. 9 shows the strip extruded onto the skeleton of FIG. 8 in an elevational view.

As can be seen from FIG. 3, the bar 20 can be formed with a longitudinal groove 25 into which plastic of the strip 26 can be extruded. The bar 20 is formed in one piece with a pair of rings 27 and 28 connected together by a ligature 29 and to the bar 20 by a ligature 30. Holes 21 can be provided in the ligatures to receive injected material of the strip 26 to further increase the attachment between the skeleton 32 of FIG. 3 and the strip 26.

The rings 27 and 28 from female closer members like those described in U.S. Pat. No. 6,557,232 and have annular ridges 33 which project from the strip 26 on one side of the fastener and lateral openings of the configuration shown at 34 in FIG. 6. Around the periphery of each ring is a flange 34 wholly embedded, like the ligatures 29, 30, in the synthetic resin of the strip 26. That can be seen from FIG. 7 in which the ligature 30 is shown to be wholly embedded in the material of the strip 26 which also fills the hole 31.

After the skeleton 32 has been formed as shown in FIG. 3 by injection molding from, for example, a relatively hard plastic like polyoxymethylene, it is placed in an injection mold in which the strip 26 is formed onto and around the skeleton. Alternatively, the strip 26 may be molded onto the skeleton while the latter is in its injection mold.

Figure 10:
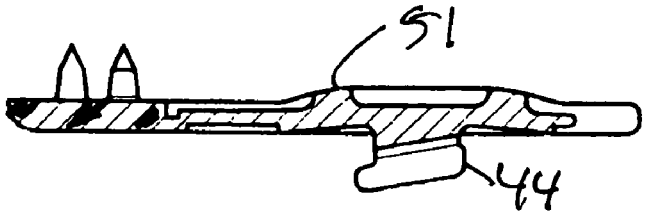
FIG. 10 is a cross sectional view taken along the line X—X of FIG. 9.

As can be seen from FIG. 6, the female members 27 and 28 can have central openings 40 which open laterally and are flanked by a pair of wings 41 which guide the male member into the opening 40 beneath a ledge 42. In order to engage beneath the ledge, the male member 43 has a stud 44 which is split at 45 and with the shape of its head as shown in FIG. 10 to slide beneath the ledge 42.

From FIGS. 8 to 11, it will be apparent that the male members 43 is also annular and forms part of a skeleton 46 with the bar 17 and a ligature 47. The bar has a groove 48 to accommodate the synthetic resin material of the strip 49. An annular flange 50 of the member 43 and the ligature of the skeleton 46 are embedded in the material of the strip 49 as can be seen from FIGS. 9 to 11. On the side opposite the side provided with the pin 44, the male member 43 has an annular ridge 51 which projects from the strip 49 on the opposite side thereof (see FIG. 11). The strips 26 and 49 can be composed of clear polyurethane and are highly flexible while the skeletons 32 and 46 are composed of a harder synthetic resin as has been noted.

We claim:

1. A garment closure comprising:

a first closure unit comprising a first one-piece closure skeleton comprised of a first bar adapted to be secured to one part of a garment, at least one first ring adapted to form a male fastener member and at least one ligature extending transversely to said bar and secured to said ring, and a generally rectangular first strip molded from a synthetic resin material of a substantially uniform width and thickness to completely embed said ligature therein while leaving portions of said member exposed on opposite sides of said strip, said strip having generally parallel longitudinal edges extending perpendicular to said bar at opposite ends thereof; and a second closure unit comprising a second one-piece closure skeleton comprised of a second bar adapted to be secured to another part of a garment, at least one second ring adapted to form a female fastener member capable of mating with said male fastener member and at least one ligature extending transversely to said bar of said second skeleton and secured to said second ring, and a generally rectangular second strip molded from a synthetic resin material of a substantially uniform width and thickness to completely embed said ligature of said second skeleton therein while leaving portions of said female member exposed on opposite sides of said second strip, said second strip having generally parallel longitudinal edges extending perpendicular to said second bar at opposite ends thereof, whereby said members are releasably engageable upon attachment of said units to the respective parts of the garment.

2. The garment closure defined in claim 1 wherein each of said skeletons is injection molded from a relatively hard synthetic resin and each of said strips is injection molded from a relatively soft synthetic resin.

3. The garment closure defined in claim 2 wherein said relatively hard synthetic resin is a polyoxymethylene and said relatively soft synthetic resin is a polyurethane.

4. The garment closure defined in claim 1 wherein one of said closure units has a plurality of respective rings selectively engageable with the member of the other closure unit to enable adjustment of the garment closure.

5. The garment closure defined in claim 1 wherein said male fastener member is a split stud having a head and said female fastener member is formed with a hole receiving said stud in a snap fit and having a lateral inlet permitting insertion of said stud in a hook-and-eye engagement.

6. The garment closure defined in claim 5 wherein each of said bars has a plurality of pointed pins formed unitarily thereon and engageable with fabric of said garment, each of said bars being welded to a cover plate at said pins.

7. The garment closure defined in claim 5 wherein each of said bars has a groove at a junction of the respective ligature with the respective bar, material of the respective strip being injection molded into said grooves.

8. The garment closure defined in claim 5 wherein at least one of said ligatures has a hole therein, material of the respective strip being injection molded into said hole.

9. The garment closure defined in claim 5 wherein each skeleton is composed of a relatively hard plastic and the respective strips are composed of a relatively soft plastic.

10. The garment closure defined in claim 9 wherein said hard plastic is polyoxymethylene and the soft plastic is polyurethane.

11. A garment comprising two parts adapted to be joined together and separated, and a garment closure comprising:

a first closure unit comprising a first one-piece closure skeleton comprised of a first bar adapted to be secured to one of said parts, at least one first ring adapted to form a male fastener member and at least one ligature extending transversely to said bar and secured to said ring, and a generally rectangular first strip molded from a synthetic resin material of a substantially uniform width and thickness to completely embed said ligature therein while leaving portions of said member exposed on opposite sides of said strip, said strip having generally parallel longitudinal edges extending perpendicular to said bar at opposite ends thereof; and a second closure unit comprising a second one-piece closure skeleton comprised of a second bar adapted to be secured to another of said parts, at least one second ring adapted to form a female fastener member capable of mating with said male fastener member and at least one ligature extending transversely to said bar of said second skeleton and secured to said second ring, and a generally rectangular second strip molded from a synthetic resin material of a substantially uniform width and thickness to completely embed said ligature of said second skeleton therein while leaving portions of said female member exposed on opposite sides of said second strip, said second strip having generally parallel longitudinal edges extending perpendicular to said second bar at opposite ends thereof, whereby said members are releasably engageable upon attachment of said units to the respective parts of the garment, each of said skeletons being injection molded from a relatively hard synthetic resin and each of said strips being injection molded from a relatively soft synthetic resin, said male fastener member being a split stud having a head and said female fastener member being formed with a hole receiving said stud in a snap fit and having a lateral inlet permitting insertion of said stud in a hook-and-eye engagement.

12. The garment defined in claim 11 wherein one of said closure units has a plurality of respective rings selectively engageable with the member of the other closure unit to enable adjustment of the garment closure.

13. The garment defined in claim 11 which is a brassiere and said parts are parts of a back strap of the brassiere.

* * * * *